US006685483B2

(12) United States Patent
Blauvelt

(10) Patent No.: US 6,685,483 B2
(45) Date of Patent: Feb. 3, 2004

(54) ELECTRICAL BREADBOARD ASSEMBLY

(75) Inventor: Eric Blauvelt, Cheshire, CT (US)

(73) Assignee: Interplex Electronics, Inc., Cheshire, CT (US)

( * ) Notice: Subject to any disclaimer, the term of this patent is extended or adjusted under 35 U.S.C. 154(b) by 0 days.

(21) Appl. No.: 10/161,074

(22) Filed: May 31, 2002

(65) Prior Publication Data

US 2003/0224667 A1 Dec. 4, 2003

(51) Int. Cl.[7] ..... H01R 29/00
(52) U.S. Cl. ..... 439/43; 439/910; 439/54
(58) Field of Search ..... 439/709, 43, 54, 439/910; 434/224

(56) References Cited

U.S. PATENT DOCUMENTS 3,540,135 A * 11/1970 Alcosser ..... 434/118
D228,136 S * 8/1973 Portugal ..... D26/1 R
4,457,721 A * 7/1984 Charvolin ..... 434/224
4,606,725 A * 8/1986 Chio ..... 434/224
5,201,664 A * 4/1993 Korsunsky et al. ..... 439/83

* cited by examiner

*Primary Examiner*—Tho D. Ta
*Assistant Examiner*—James R. Harvey
(74) *Attorney, Agent, or Firm*—McCormick, Paulding & Huber LLP

(57) ABSTRACT

A transparent base supports two or more socket boards side-by-side. Binding posts are arrayed on the longer side of one rectangular socket board. Turning the assembly over allows the user to see how the sockets are connected to the busbars on the backsides of the side-by-side socket boards.

4 Claims, 3 Drawing Sheets

ELECTRICAL BREADBOARD ASSEMBLY

BACKGROUND OF THE INVENTION

This invention relates generally to electrical breadboard assemblies, and deals more specifically with the breadboard assembly that includes at least two socket boards arranged side-by-side on a transparent base or plate and which allows inspection of the rear face of each of the socket boards to assist the user in ascertaining which of the arrays of sockets in the front face of the socket boards are electrically connected by individual busbars provided in the rear face of each of the socket boards. Design Pat. No. D228 136 issued Aug. 14, 1973, shows a typical socket board of the type provided in the present invention. Such boards are for use in breadboarding circuits by providing conductive leads from either a power source of a particular voltage, or a signal from some other electrical device to a circuit the user will design and build, generally for test purposes. The typical electrical engineering student in a laboratory course, for example, has need of breadboarding circuits to conduct the necessary training in a hands on environment, so as to better learn the fundamentals of electronics outside of the classroom environment.

SUMMARY OF THE INVENTION

The present invention seeks to provide the student with a convenient means for ascertaining the precise interconnections between sockets and the busbars normally provided on the rear face of a typical breadboard or socket board. In order to carry out various experiments in the laboratory environment, or in any test environment he will need to know this relationship.

In accordance with the present invention a breadboard assembly is provided wherein at least two opaque plastic socket boards having front and back faces are arranged side-by-side. The front faces define socket openings for receiving electrical leads, the back faces defining recesses communicating with sets of said socket openings. Busbars are provided in these recesses at the back faces of the socket boards for electrically connecting the socket openings within sets, or arrays of sockets, provided on the front side of the socket board. A transparent plastic base supports these two opaque plastic boards so that the entire assembly can be turned over and the user can inspect the pattern of busbars at the rear faces of the side-by-side socket boards to aid him in making the necessary connections on the front side of the board to carry out his laboratory experiment or test set up, as the case may be.

BRIEF DESCRIPTION OF THE DRAWINGS

A more complete understanding of the invention and many of its attendant advantages will be readily appreciated as the same become better understood by reference to the following detailed description, when considered in conjunction with the accompanying drawings.

DETAILED DESCRIPTION OF PREFERRED EMBODIMENTS

Figure 1:
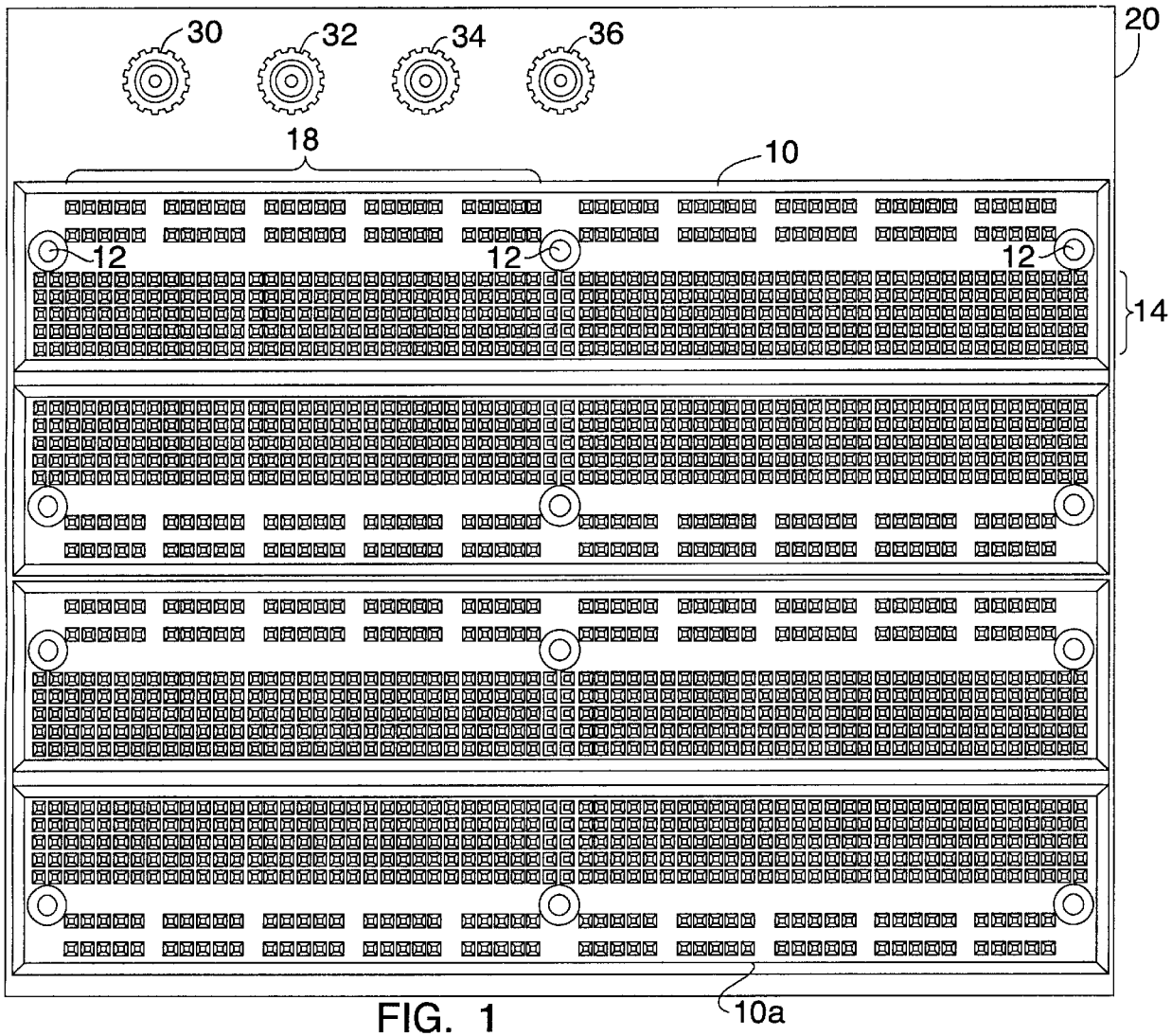
FIG. 1 shows in top plan view a pair of opaque plastic circuit boards arranged in side-by-side relationship on a base.

Turning now to FIG. 1 in greater detail, a pair of rectangular opaque plastic socket boards 10 and 10*a* are provided in side-by-side relationship, and preferably are secured to an underlying transparent plastic base 20. These socket boards 10 and 10*a* each have a pattern of screw openings, best shown at 12, 12 that receive screws (not shown) which can be used to attach the socket boards to the base in a conventional fashion.

Also secured to the base 20 are an array of electrical binding posts 30, 32, 34 and 36 which serve as a convenient connection point for the breadboard assembly to selected sources of electrical power and/or input signals which might be provided to the student, or user of the device, in connection with laying out a particular electronic circuit arrangement. These binding posts 30–36 inclusive are of conventional configuration and are of standard type well known to those skilled in the art. So too, the socket boards 10 and 10*a* are also conventional and readily discernable in their construction from Design Pat. No. D 228,136.

Figure 3:
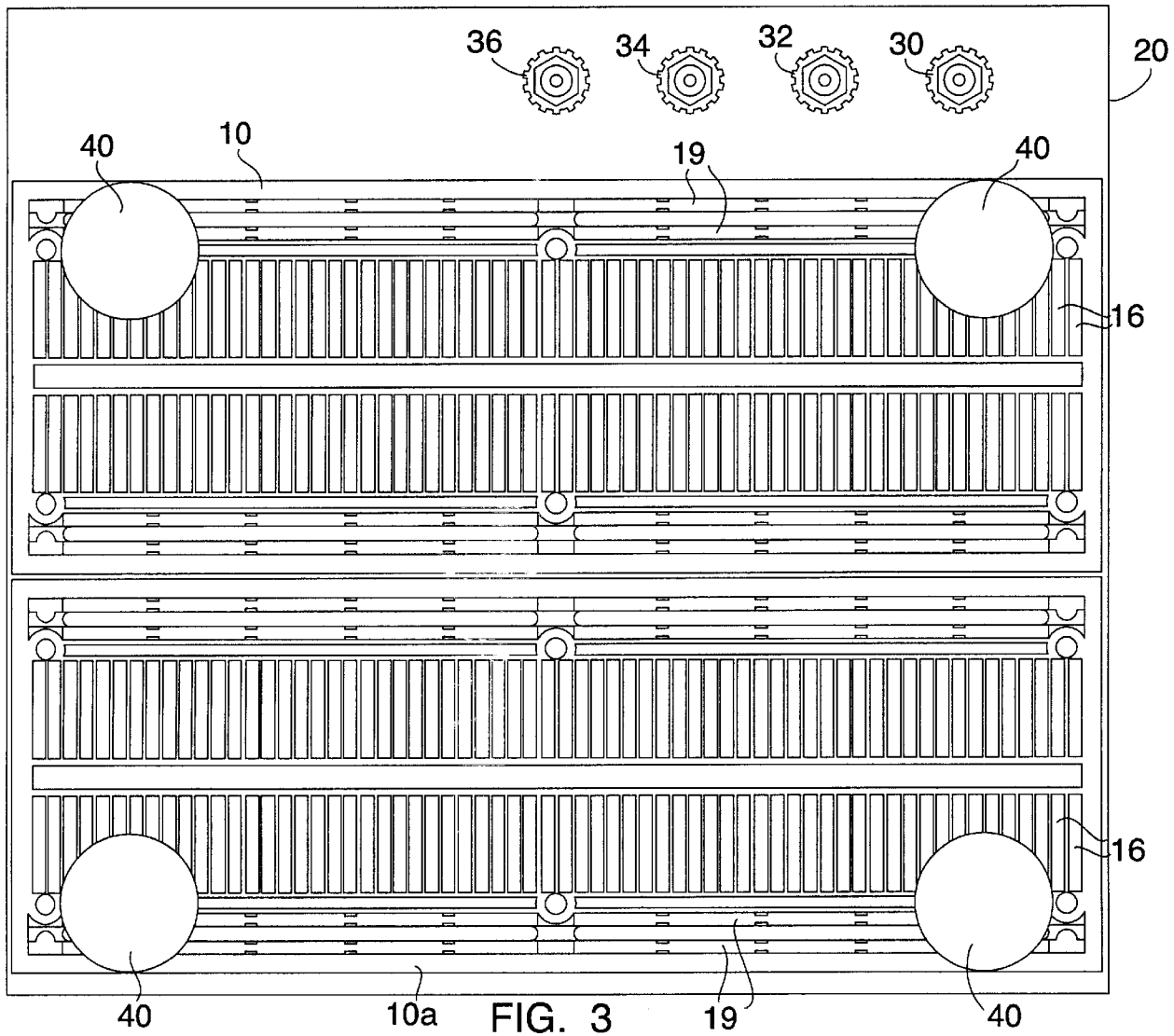
FIG. 3 is a bottom plan view of the breadboard assembly illustrated in FIGS. 1 and 2.

Turning now to a more detailed description of the socket boards 10 and 10*a*, each is of generally rectangular configuration and these socket boards are preferably identical to one another, each having a front face as best shown in FIG. 1 that defines a plurality of sets of socket openings as, for example, the set of 5 illustrated at 14 in FIG. 1, which set of 5 are electrically connected to one another by a busbar seen at 16 in FIG. 3.

Another set of socket openings indicated at 18 in FIG. 1, comprising 25 socket openings are electrically connected to a common busbar indicated at generally at 19 in FIG. 3.

The pattern of socket openings and busbars can be readily seen from observing and comparing their relative locations in FIG. 1 and FIG. 3, and this exercise will illustrate to the reader how the user of the breadboard assembly of the present invention can be turned over by the user to readily ascertain the electrical relationships between the socket openings on the front face on the socket boards and the busbars provided at the rear or back faces of each of these socket boards 10 and 10*a*.

Figure 2:
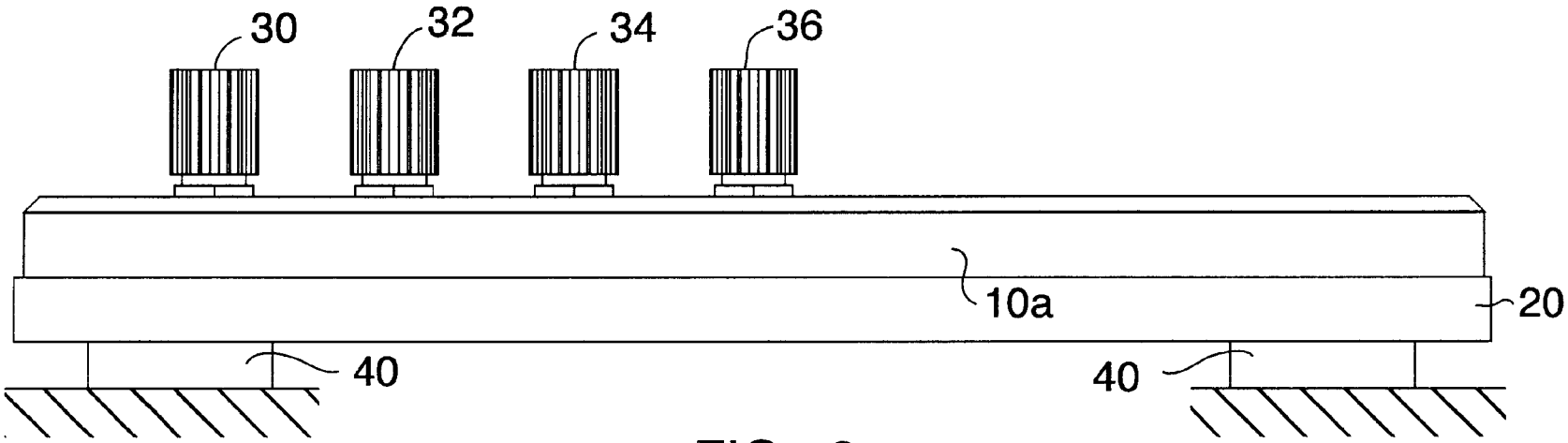
FIG. 2 is an end elevational view of the breadboard assembly of FIG. 1.

Finally, and as best shown in FIG. 2, non-skid rubberized feet 40, 40 are preferably provided at the rear face of the transparent plastic plate or base 20, so as to allow the breadboard assembly to be set upon a slippery or slick surface, and nevertheless utilized in the manner anticipated for such a training aid in the laboratory or workplace environment.

In light of the above, it is therefore understood that within the scope of the appended claims, the invention may be practiced in the manner described, or perhaps otherwise then as specifically described, and is limited only by the scope of these appended claims.

I claim:

1. A breadboard assembly comprising:

at least two opaque plastic boards having front and back faces, the front face defining socket openings for receiving electrical leads, the back face defining recesses communicating with sets of said socket openings, and busbars in said recesses for electrically connecting the socket openings within each set, and a transparent plastic base on which said at least two opaque breadboards are mounted, at least one foot for supporting said transparent plastic base on a work surface or the like.

2. The breadboard assembly of claim 1 further comprising binding posts mounted on said base adjacent one of said at least two boards.

3. A breadboard assembly comprising:

at least two opaque plastic boards having front and back faces, the front face defining socket openings for receiving electrical leads, the back face defining recesses communicating with sets of said socket openings, and busbars in said recesses for electrically connecting the socket openings within each set, and a transparent plastic base on which said at least two opaque breadboards are mounted;

binding posts mounted on said base adjacent one of said at least two boards; and four feet for supporting said transparent plastic base on a work surface of the like.

4. A breadboard assembly comprising:

at least two opaque plastic boards having front and back faces, the front face defining socket openings for receiving electrical leads, the back face defining recesses communicating with sets of said socket openings, and busbars in said recesses for electrically connecting the socket openings within each set, and a transparent plastic base on which said at least two opaque breadboards are mounted;

binding posts mounted on said base adjacent one of said at least two boards;

four feet for supporting said transparent plastic base on a work surface of the like; and said boards are rectangular and arranged side-by-side on said base.

* * * * *